US008544691B2

(12) United States Patent
Roosel et al.

(10) Patent No.: US 8,544,691 B2
(45) Date of Patent: Oct. 1, 2013

(54) SYSTEM FOR FASTENING A DISPENSING PUMP ON THE NECK OF A BOTTLE CONTAINING A FLUID PRODUCT

(75) Inventors: Thomas Roosel, Notre Dame d'Aliermont (FR); Pierre Dumont, Incheville (FR)

(73) Assignee: Rexam Dispensing Systems S.A.S. (FR)

( * ) Notice: Subject to any disclaimer, the term of this patent is extended or adjusted under 35 U.S.C. 154(b) by 338 days.

(21) Appl. No.: 12/845,359

(22) Filed: Jul. 28, 2010

(65) Prior Publication Data

US 2011/0024465 A1 Feb. 3, 2011

(30) Foreign Application Priority Data

Jul. 28, 2009 (FR) ..... 09 03712

(51) Int. Cl.
*B67B 1/00* (2006.01)

(52) U.S. Cl.
USPC ..... 222/153.01; 222/153.04; 222/153.13; 222/321.9

(58) Field of Classification Search
USPC ..... 222/320, 321, 321.7, 321.9, 381.1, 222/153.12, 153.13, 153.14, 153.01, 153.04; 215/271, 272
See application file for complete search history.

(56) References Cited

U.S. PATENT DOCUMENTS

| | | | | |
|---|---|---|---|---|
| 4,773,553 | A | 9/1988 | Van Brocklin | |
| 5,799,810 | A * | 9/1998 | de Pous et al. | 215/274 |
| 6,206,246 | B1 * | 3/2001 | Bougamont et al. | 222/321.9 |
| 6,394,318 | B1 * | 5/2002 | Klodzinski | 222/321.7 |
| 6,874,664 | B1 * | 4/2005 | Montgomery | 222/525 |
| 7,451,899 | B2 * | 11/2008 | de Pous | 222/321.9 |
| 7,780,043 | B2 * | 8/2010 | Jourdin et al. | 222/321.9 |
| 7,874,465 | B2 * | 1/2011 | Bertin et al. | 222/402.12 |
| 7,997,451 | B2 * | 8/2011 | Carnacina | 222/153.11 |
| 2002/0096539 | A1 * | 7/2002 | Milian et al. | 222/153.11 |
| 2008/0035679 | A1 * | 2/2008 | Lompech et al. | 222/321.9 |
| 2009/0224005 | A1 * | 9/2009 | Jourdin et al. | 222/321.9 |
| 2012/0061422 | A1 * | 3/2012 | Beranger et al. | 222/321.1 |
| 2012/0068030 | A1 * | 3/2012 | Behar | 248/224.7 |

FOREIGN PATENT DOCUMENTS

| | | | |
|---|---|---|---|
| EP | 0704251 | A2 | 4/1996 |
| WO | 0053335 | A1 | 9/2000 |
| WO | 2006129043 | A2 | 12/2006 |

OTHER PUBLICATIONS

French Search Report and Written Opinion; Application No. FR 0903712; Mar. 22, 2010; 6 pages.

* cited by examiner

*Primary Examiner* — Frederick C Nicolas
*Assistant Examiner* — Bob Zadeh
(74) *Attorney, Agent, or Firm* — St. Onge Steward Johnston & Reens LLC

(57) ABSTRACT

A system for fastening a dispensing pump on the neck of a bottle containing a fluid product, the system including a sleeve having an interior collar for fastening of the pump and a lower skirt provided with fasteners for fastening the sleeve on the bottle, the system further including a hoop slidably mounted around the skirt between a top position wherein the fasteners are free and a bottom position wherein the fasteners are constrained by the hoop, the system further including an exterior collar mounted around the interior collar by the intermediary of a device for displacing the exterior collar between a bottom usage position and a top dismounting position, the hoop at the bottom position being attached to the exterior collar in order to actuate the displacement of the collar towards its top position by driving the hoop relatively to the skirt on a stroke that is sufficient to release the fasteners.

12 Claims, 5 Drawing Sheets

SYSTEM FOR FASTENING A DISPENSING PUMP ON THE NECK OF A BOTTLE CONTAINING A FLUID PRODUCT

CROSS-REFERENCE TO RELATED APPLICATIONS

The present application claims priority of French patent application No. 09 03712 filed on Jul. 28, 2009, the content of which is incorporated herein by reference.

FIELD OF THE INVENTION

The invention relates to a system for fastening a pump for dispensing on the neck of a bottle containing a fluid product, as well as a bottle for dispensing a fluid product comprising a pump fixed to the means of such a system. In particular, the bottle allows for the conditioning and the dispensing of a liquid or of a cream, for example a perfume, for a cosmetic or pharmaceutical application.

BACKGROUND OF THE INVENTION

Such bottles comprising a body defining a reservoir for conditioning the product are known, a neck surmounting said body by defining an upper opening for said reservoir, and a pump mounted in said upper opening by arranging the means of supplying of said pump inside said reservoir. As such, the pump makes it possible to restore the product conditioned in the reservoir.

In order to provide for the positioning and the fastening of the pump in relation to the body, a system can be used comprising a sleeve having a collar bearing means of fastening of the pump and a lower skirt with provided means of fastening of said sleeve on said bottle.

The system for fastening further comprises a hoop slidably mounted around the skirt between a top position wherein the means of fastening are free in such a way as to allow for the positioning of said skirt around the neck and a bottom position wherein the means of fastening are constrained by said hoop in order to provide the sealed fastening of the sleeve on said neck.

In particular, U.S. Pat. No. 4,773,553 discusses the use of a skirt provided with claws which has an open configuration in order to allow for its positioning around the neck, said claws being pulled back and maintained in position under the neck during the sliding of the hoop towards its bottom position.

The hoop, in particular made of rigid material, as such forms a tool for pulling back claws and makes it possible to provide the maintaining over time of the claws in folded position, in particular relatively to the variations in temperature. Furthermore, it can procure an aesthetic effect by forming trim for masking the neck, the junction zone between the body and the neck (referred to as the shoulders of the body), as well as possibly the lower portion of the pump.

The problem that arises with the use of such systems according to prior art is that the fastening of the pump is irremovable. Or, in terms of ecological recycling problems at the end of the lifespan of the bottle, it is current to facilitate the separation of the pump constituted substantially of plastic and metal materials, from the body often carried out in a category of different plastic material or glass.

In order to solve this problem, the use of sleeves which can be screwed on the neck is known. However, perfumers, cosmeticians or pharmacists do not generally desire that the sleeves can be unscrewed and rescrewed easily by the user, in particular for reasons of possible degradation of the product distributed or of a change in the purpose of the bottle.

In addition, the screwable sleeves necessarily leave an unsightly functional spacing between the bottom of said sleeve and the shoulders of the body. Also, their screwing on the filling lines is slow and therefore expensive. Moreover, the screwable sleeves must be screwed on the filling lines according to a very precise torque that has to be perfectly complied with in order to provide for their sealing on the neck.

SUMMARY OF THE INVENTION

The invention aims to perfect the prior art by proposing in particular a system for fastening a pump on the neck of a bottle which allows for their quasi-irreversible separation at the end of recycling, and this by having an advantageous aesthetics and simplicity in terms of fastening.

To this effect, and according to a first aspect, the invention proposes a system for fastening a dispensing pump on the neck of a bottle containing a fluid product, said system comprising a sleeve having an interior collar bearing means of fastening of the pump and a lower skirt provided with means of fastening of said sleeve on said bottle, said system further comprising a hoop slidably mounted around the skirt between a top position wherein the means of fastening are free in such a way as to allow for the positioning of said skirt around the neck and a bottom position wherein the means of fastening are constrained by said hoop in order to provide the sealed fastening of the sleeve on said neck, said system further comprising an exterior collar mounted around the interior collar by the intermediary of a device for displacing said exterior collar between a bottom usage position and a top dismounting position, the hoop in the bottom position being attached to the exterior collar in order to actuate the displacement of said collar towards the top position by driving said hoop relatively to the skirt on a stroke that is sufficient to release the means of fastening.

According to a second aspect, the invention proposes a bottle for dispensing a fluid product, comprising a body defining a reservoir for conditioning of said product, a neck surmounting said body by defining an upper opening for said reservoir, and a pump mounted in said upper opening by arranging the means of supplying of said pump inside said reservoir, said bottle further comprising such a system for fastening, the pump being attached to the interior collar and the means of fastening of the skirt being constrained by the hoop in the bottom position in order to provide for the sealed fastening of the sleeve on the neck.

BRIEF DESCRIPTION OF THE DRAWINGS

Other objects and advantages of the invention shall appear in the following description, provided in reference to the annexed figures, wherein.

DETAILED DESCRIPTION OF THE INVENTION

Figure 1:
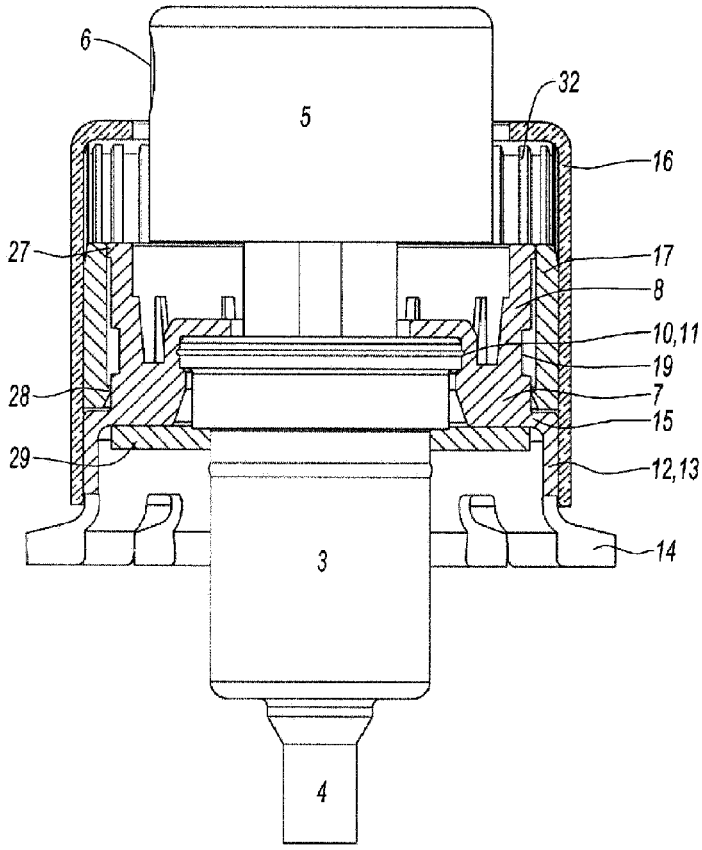
FIG. 1 is a longitudinal section representation of a system for fastening according to an embodiment of the invention wherein a pump (non-sectioned) is attached, said system being in positioning configuration on the neck of a bottle with the hoop in the top position and the exterior collar in the bottom position.

In the description, the terms of positioning in the space are taken in reference to the position of the system for fastening shown in the figures.

In relation with the figures, a bottle intended to contain a fluid product for the purposes of its dispensing is described hereinbelow. In particular examples, the product can be a liquid or a cream, for example a perfume, for a cosmetic or pharmaceutical application.

The bottle comprises a body 1 which can be formed from rigid material, in particular glass or a plastic material, in order to define a reservoir for conditioning the product. The body 1 is surmounted by a neck 2 formed of a single part with said body by defining an upper opening for the reservoir. According to an embodiment, the neck 2 is of the carnette type such as made standard by the FEA standard in Europe, without the invention being restricted to such a type of neck.

The bottle for dispensing further comprises a pump 3 mounted in the upper opening by arranging the means of supplying of said pump inside the reservoir. The pump shown comprises a body of which the periphery is mounted without clamping in the opening.

The body of the pump 3 has a lower portion which is provided with a supplying orifice, the means of supplying comprising a plunger tube 4 having an upper portion fixed in the orifice and a lower portion arranged against the bottom of the reservoir.

Moreover, the pump comprises a push-button 5 provided with a dispensing orifice 6. According to a known embodiment, the button 5 actuates in reversible translation a nozzle on a dispensing stroke and a piston is also mounted on the nozzle between a state for sealing and a state for supplying orifices of the nozzle. However, the invention is not restricted to a particular embodiment of the pump 3.

The bottle can also be provided with a protective cover of the pump between two uses. Alternatively, the pump can be lockable, in particular by rotation of the push-button between a position of dispensing and a position wherein the pressing on the push-button is blocked.

In order to provide for the positioning and the fastening of the pump 3 on the neck 2, the bottle further comprises a system for fastening comprising a sleeve 7 which can be carried out in a one-piece manner of ductile material, in particular plastic material of the polyolefin type.

In the upper portion, the sleeve 7 has an interior collar 8 which bears means of fastening of the pump 3. In the embodiment shown, an armature of association of the pump 3 is formed in the interior collar 8 in order to render said pump integral with the sleeve 7. In an alternative not shown, the sleeve 7 can be integrated into the body of the pump 3, for example by forming an extender for said pump, the means of fastening then being permanent.

In particular, the armature of association comprises an orifice 9 wherein the pump 3 is mounted with the push-button 5 arranged above the sleeve 7, said armature further comprising a groove for the snap-fitting 10 of a bead 11 formed on the body of the pump 3.

The sleeve 7 also has a lower skirt 12 which extends axially from a part under the interior collar 8, said skirt being provided with means of fastening of said sleeve on the bottle. In particular, the skirt 12 can be deformed between a mounting configuration wherein said skirt can be positioned around the neck 2 and a clamping configuration of said skirt around said neck in order to provide for the fastening. For this, the skirt 12 can form an interior envelope with respectively conical geometry for the positioning and cylindrical for the fastening.

In the embodiment shown, the skirt 12 has an upper crown 13 under which extend claws 14 forming means of fastening. Moreover, the crown 13 is connected to the lower end of the interior collar 8 by the intermediary of an inward shoulder 15.

The system for fastening further comprises a hoop 16 made of a single part, in particular of rigid material such as a metal and for example aluminium. The hoop 16 is slidably mounted around the skirt 12 between a top position wherein the means of fastening are free in such a way as to allow for the positioning of said skirt around the neck 2 and a bottom position wherein the means of fastening are constrained by said hoop in order to provide the sealed fastening of the sleeve 7 on said neck.

As such, the fastening of the pump 3 on the bottle is carried out by attaching said pump to the interior collar 8, the means of fastening of the skirt 12 being constrained by the hoop 16 in the bottom position in order to provide the sealed fastening of the sleeve 7 on said neck 2.

Figure 5:
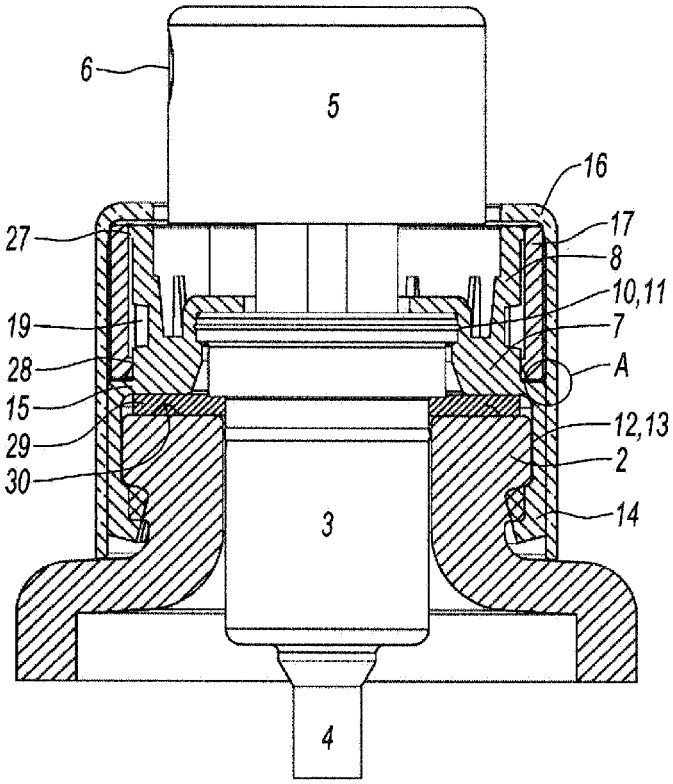
FIG. 5 is a partial longitudinal section representation of a pump (non-sectioned) fixed on the neck of a bottle by means of the system for fastening according to FIG. 1.
Figure 7:
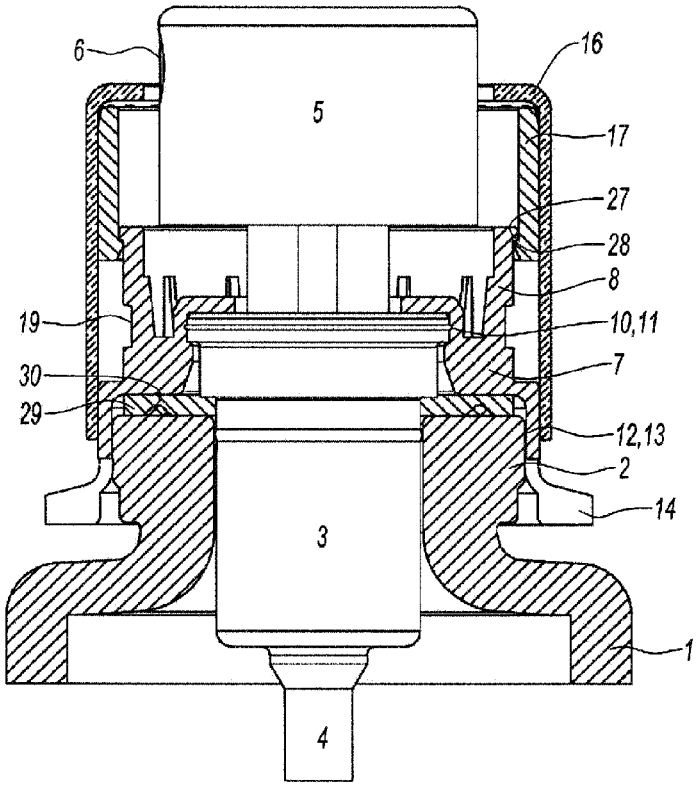
FIG. 7 is a representation analogous to FIG. 5 wherein the exterior collar is in the top position for the dismounting of the fastening system—pump unit.

In the embodiment shown, the inside diameter of the hoop 16 is arranged in order to allow for a sliding of said hoop on the crown 13, the claws 14 in the free state being arranged in relief in relation to said crown (FIGS. 1, 7). The hoop 16 in the top position is mounted around the crown 13 and, in the bottom position, the sliding of the hoop 16 around the claws 14 constrain their pulling back then their radial maintaining under the neck 2 (FIG. 5).

In an alternative not shown, the claws 14 in the free state can be arranged substantially in the axial extension of the crown 13, the hoop 16 at the bottom position then providing the radial maintaining of said claws in order to provide the sealed fastening of the sleeve 7 on the neck 2.

The system for fastening further comprises an exterior collar 17 which is mounted around the interior collar 8 by the intermediary of a device for displacing said exterior collar between a bottom usage position and a top dismounting position. In particular, the exterior collar 17 is mounted above the inward shoulder 15 and has a thickness substantially equal to the length of said shoulder in such a way that the exterior of said collar is substantially in the axial extension of the exterior of the crown 13.

Moreover, the hoop 16 in the bottom position is attached to the exterior collar 17 in order to actuate the displacement of said collar towards its top position by driving said hoop relatively to the skirt 12 on a stroke that is sufficient to release the means of fastening (FIG. 7). In particular, the stroke can correspond to that relative to the passage of the hoop 16 from its top position towards its bottom position, the exterior collar 17 at the top position then making it possible to arrange the hoop 16 in the top position.

As such, after fastening of the pump 3 (FIG. 5), it is possible to dismount the fastening system—pump 3 unit by exerting a force adapted on the hoop 16 in such a way as to actuate the displacement relatively to the skirt 12 of the exterior collar 17—hoop 16 unit. As such, the constraints of recyclability of the components of the bottle can be satisfied simply.

The device for displacing can be at least partially actuated in rotation by the hoop 16. As such, the dismounting is carried out by an intuitive unscrewing movement, in particular in the anti-clockwise direction, by the intermediary of the hoop 16. This embodiment therefore combines the advantages of a fastening by means of a deformable sleeve 7 with the possibility of unscrewing said sleeve, and this without the disadvantages of each one of these embodiments.

In particular, the system for fastening makes it possible to provide a hoop 16 which, at the bottom position, coming as a support without play against the shoulders of the body 1 (FIG. 5) in such a way as to perfect the aesthetics of the bottle. Furthermore, the bottles are particularly simple to install on the filling lines since the mounting of the pump 3 does not require screwing.

According to the embodiment shown, the dismounting is carried out by a kinematics of the bayonet type comprising a rotation followed by a translation of the exterior collar 17—hoop 16 unit in relation to the skirt 12. Alternatively, a rotation alone can be provided, the device for displacing being then arranged for transforming a force of rotation on the hoop 16 in a movement of translation of the exterior collar 17—hoop 16 unit.

In order to avoid an untimely dismounting of the fastening system—pump 3 unit, the device for displacing can include means of locking of the exterior collar 17 in the bottom position, said means being deactivated by the application of a threshold force.

Furthermore, the device for displacing can include a maintaining thrust bearing of the exterior collar 17 at the top position on the interior collar 8. As such, in the dismounting position of FIG. 7, it is possible to unitarily remove the fastening system—pump 3 unit by traction on the hoop 16.

According to an embodiment, the collars 8, 17 are coaxial, the exterior collar 17 having an axial interior surface 17*a* and the interior collar 8 having an axial exterior surface 8*a* surrounded by said interior surface, the device for displacing being provided between said surfaces.

In particular, the device for displacing can include at least one protrusion 18 attached to one of the surfaces 17*a*, 8*a*, said protrusion being mounted in at least one slideway 19 attached to the other surface 8*a*, 17*a*, the sliding of the protrusion 18 in the slideway 19 inducing the displacement of the exterior collar 17 from its bottom position towards its top position.

In the embodiments shown, the interior surface 17*a* has two diametrically opposite protrusions 18, a slideway 19 for each one of said protrusions being formed on the exterior surface 8*a*. In relation with the FIGS. 2 and 3, the slideways 19 have:

- a peripheral portion 20 which extends over a sector of the exterior surface 8*a*, said peripheral portion not being cross-through; and
- a cross-through axial upper portion 21 in the exterior surface 8*a*, said portion comprising an upper opening 22 and communicating in the lower portion in the peripheral portion 20.

As such, when the exterior collar 17 is in the bottom position, each protrusion 18 is arranged in the blind end 23 of the peripheral portion 20. Then, during the dismounting by actuation in rotation of the hoop 16, the protrusions 18 slide in the peripheral portions 20 in order to reach the axial upper portions 21 and, via traction on the hoop 16, the protrusions 18 slide in said upper portions in order to arrange the exterior collar 17 at the top position. In particular, the axial length of the upper portions 21 is sufficient to release the means of fastening of the skirt 12.

Figure 2A:
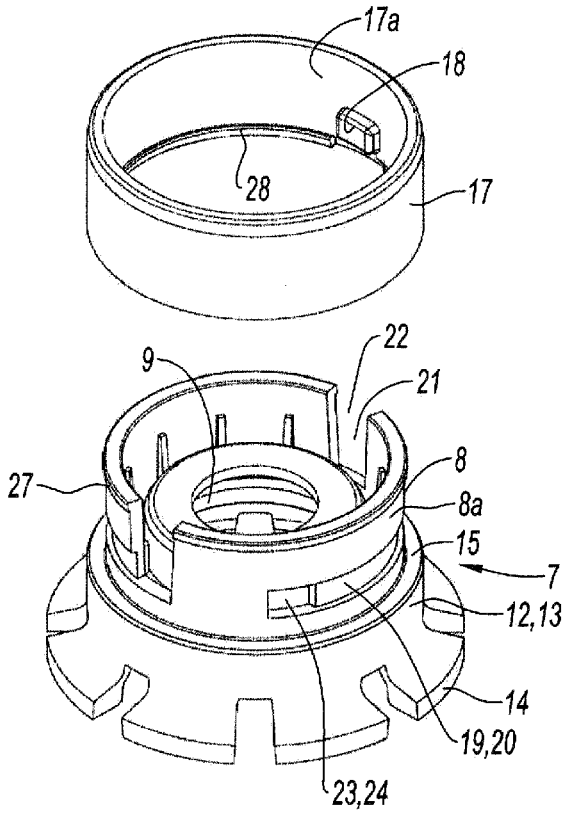
FIG. 2 show the sleeve and the exterior collar of the system for fastening according to FIG. 1, respectively in an exploded perspective (FIG. 2*a*) and sectioned longitudinally in the top position (FIG. 2*b*)

In relation with the FIG. 2, the peripheral portions 20 extend in a radial plane, the exterior collar 17 then remaining in the bottom position during the sliding of the protrusions 18 in these portions 20. In an alternative shown in the FIG. 3*b*, the peripheral portion 20 can be inclined upwards in order to imprint an ascending movement to the exterior collar 17 during the sliding of the protrusion 18 in this portion 20. In an alternative not shown, the slideway 19 can be devoid of axial portion, the peripheral portion 20 extending then helicoidally in order to displace the exterior collar 17 from its bottom position towards its top position.

Figure 8A:
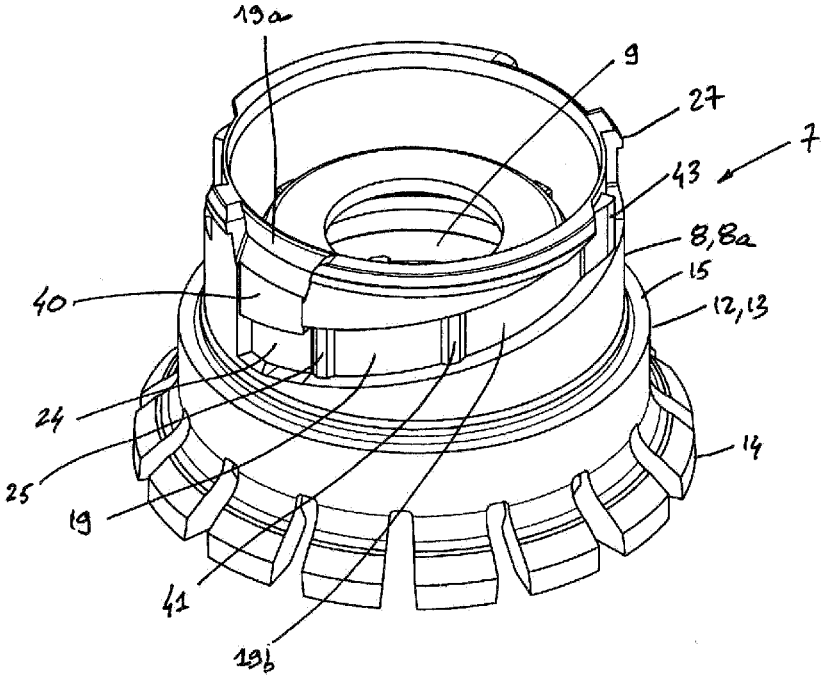
FIGS. 8*a* and 8*b* are perspective representations of a sleeve according to another embodiment of the invention.
Figure 8B:
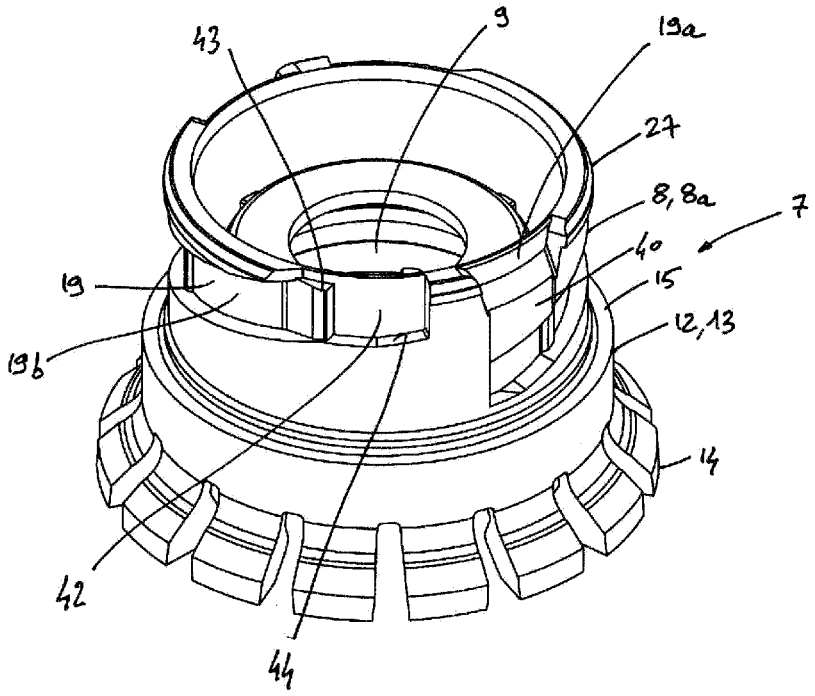

In relation with the FIG. 8, the slideways 19 extend over a sector of the exterior surface 8*a* and have an axial portion 19*a* and a helical portion 19*b*, each protrusion 18 being arranged in an axial portion 19*a* in order to guide the displacement in translation of the exterior collar 17 from its top position towards its bottom position. Then, during the dismounting by actuation in rotation of the hoop 16, the protrusions 18 slide in the helical portions 19*b* in order to displace said exterior collar in the top position.

The slideway 19 can have a housing 24 for retaining the protrusion 18, said housing forming a means of locking of the exterior collar 17 in the bottom position. In the FIGS. 2 and 3, the housing 24 is formed in the vicinity of the blind end 23 of the peripheral portion 20.

Figure 3A:
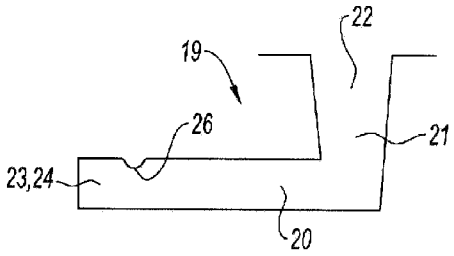
FIGS. 3*a* and 3*b* show respectively an alternative embodiment of a slideway for a device for displacing of the exterior collar.
Figure 3B:
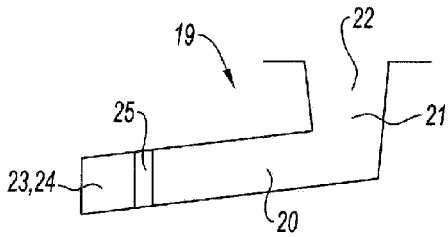

In the FIGS. 2 and 3*b*, the housing 24 extends radially in order to all for the arrangement of the protrusion 18 inside of it, the passage of the rear edge of said housing by the protrusion 18 requiring a threshold force for the unlocking of the device for displacing. According to FIG. 3*b*, the rear edge can be provided with a radial boss 25 in order to make reliable the arrangement of the protrusion 18 in the housing 24 by increasing the unlocking force.

According to FIG. 3*a*, the housing 24 is delimited by boss 26 which extends axially in the peripheral portion 20, the passage of the protrusion 18 on said boss making the locking reliable and conferring the force required for the unlocking.

In relation with the FIG. 8, the housing 24 is formed between a radial boss 25 formed at the junction between the axial 19*a* and helical 19*b* portions in such a way as to require a threshold force of unlocking of the device for displacing. Furthermore, the axial portion 19*a* is provided with a protrusion 40 which has a bevelled upper face in order to allow for the sliding of the protrusion 18 on it during the mounting of the exterior collar 17 in the bottom position and an angular lower face in order to provide for the axial locking of said protrusion in the housing 24 in order to lock the exterior collar 17 in the bottom position.

In particular, the protrusion 40 is arranged in such a way that the upper edge of the interior collar 8 forms a pre-positioning surface of the exterior collar 17 in the top position. Moreover, the boss 40 has a height such that the axial dimension of the housing 24 is slightly less than that of the helical portion 19*b* in order to avoid a spacing of the protrusion 18 in the housing 24 while still favouring the sliding of said protrusion in said helical portion.

The slideway 19 shown is also provided with an intermediary radial boss 41 which makes it possible, in the event of accidental dismounting, to form a hard point on the rotating stroke in order to alert the user before the means of fastening are released.

At the end of the dismounting stroke, the helical portion 19*b* is provided with a housing 42 wherein the protrusion 18 is arranged. In particular, the housing 42 is delimited laterally by a thrust bearing 43 which is arranged to prevent the returning of the protrusion 18 in the slideway 19 and therefore the remounting of the pump 3. Furthermore, the housing 42 has a lower edge 44 which is arranged to, even in the case of axial engagement on the exterior collar 17, prevent the arrangement of the hoop 16 in the bottom fastening position.

In the embodiment shown, the hoop 16 is slidably mounted around the exterior collar 17 between its high and low positions, more precisely around the interior surface 17*a* of said collar. In particular, a clamping force is provided at the interface between the hoop 16 and the exterior collar 17.

Figure 2B:
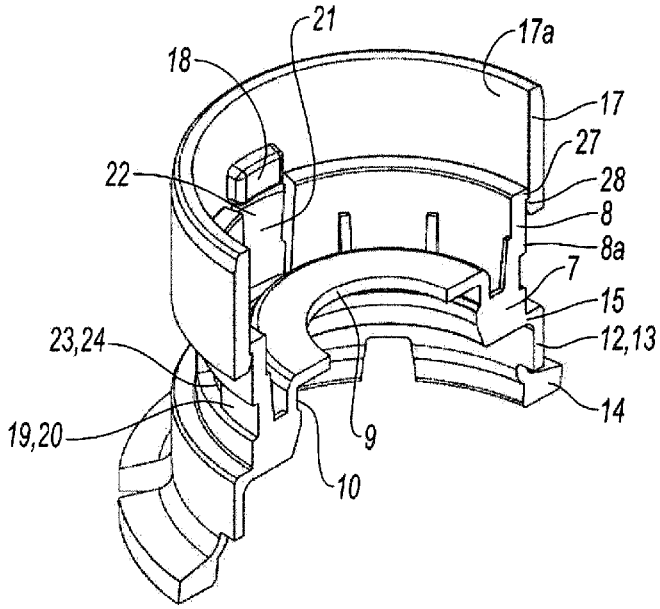

Moreover, the upper edge of the interior collar 8 has a radial core 27 which cooperates with a radial core 28 formed in the lower edge of the exterior collar 17 in order to maintain the exterior collar 17 in the top position on the interior collar 8 (FIGS. 2*b*, 7).

In relation with the FIG. 2, the openings 22 of the slideways 19 emerge in the radial core 27. As such, via elastic deformation of the exterior collar 17 which is crossed by the axial portions 21 of the slideways 19, the protrusions 18 can be arranged in the slideways 19 then the clamping force conferred by the hoop 16 on the exterior collar 17 makes it possible to make the cooperation of the cores 27, 28 reliable in order to be able to maintain the exterior collar 17 in the top position on the interior collar 8. In particular, the maintaining can be sufficient to resist a traction force on the hoop 16 during the dismounting of the fastening system—pump 3 unit.

In relation with the FIG. 8, the axial portions 19*a* as well as the housing 42 emerging in the radial core 27 in such a way as to allow for the pre-positioning of the exterior collar 17 in the top position and the maintaining of said collar on the interior collar 8 after dismounting.

Moreover, in order to drive in displacement the exterior collar 17 —hoop 16 unit relatively to the skirt 12, the actuating force, in particular in rotation, of the device for displacing is less than that of the displacement of the sleeve 7.

For this, it can be provided that the clamping at the interface between the hoop 16 and the exterior collar 17 be greater than the clamping at the interface between said hoop and the skirt 12. For example, the outside diameter of the crown 13 can be slightly less than that of the exterior collar 17.

The force for the displacement of the sleeve 7 can also be increased by providing friction zones. In particular, in the embodiment shown, the system for fastening comprises an annular seal 29 which is arranged in the sleeve 7 in order to be on the one hand in axial engagement on the upper wall of the neck 2 and on the other hand in axial engagement on the extension of the lower wall of the inward shoulder 15, said engagements conferring a resistive force with regards to the rotation of said sleeve in relation to said neck.

Furthermore, the upper wall has a core in relief 30 increasing the resistive force, this core able to be continuous or interrupted. In an alternative not shown, the core can be a hollow groove. Alternatively, the body of the pump 3 can be maintained, possibly in a leaktight manner, in the opening of the body 1.

Moreover, the neck 2 and/or the sleeve 7 can be provided with reciprocal means of retaining in rotation, the retaining force conferred by said means being greater than the torque required to actuate in rotation the exterior collar 17 from its bottom position towards its top position.

Figure 6A:
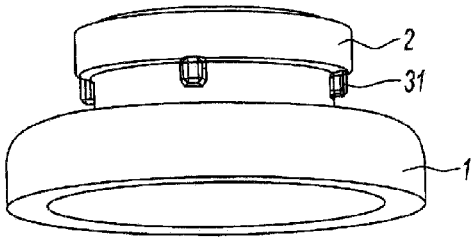
FIG. 6*a* is a partial perspective representation showing the neck of the bottle according to FIG. 5.

In relation with the FIG. 6, the neck 2 has at least one rotating stop 31 bearing claws 14 in folded position. In FIG. 6*a*, stop bearings are formed under the neck 2, the section of these stops can be rectangular or triangular. In particular, the number of stop bearings 31 can be equal or be a sub-multiple or a multiple of the number of claws 14 in order to avoid obstructing of the pump 3 during the positioning of the device for fastening on the neck 2. In FIG. 6*a*, four stop bearings 31 are provided to cooperate with eight claws 14.

Figure 6B:
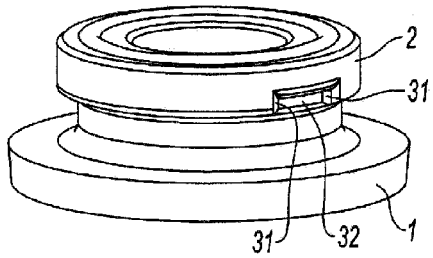
FIG. 6*b* is a partial perspective representation of a neck of a bottle according to another embodiment of the invention.

FIG. 6*b* shows the carrying out of stop bearings 31 on the exterior periphery of the neck 2. More precisely, the lower portion of the periphery of the neck 2 has two diametrically opposite cavities 32, said cavities emerging under said neck. The claws 14 in folded position are inserted into said cavities in such a way that the edges of said cavities form stop bearing 31.

In the embodiment shown, the hoop 16 at the bottom position and the exterior collar 17 have reciprocal means of fastening. As such, after arrangement in the bottom position, the hoop 16 is attached to the exterior collar 17 in order to allow for their joint displacement, in particular in rotation.

Furthermore, the means of fastening are interrupted on the interface between the hoop 16 in the bottom position and the skirt 12, in such a way as to not drive the sleeve 7 in displacement together to the exterior collar 17—hoop 16 unit.

Figure 4:
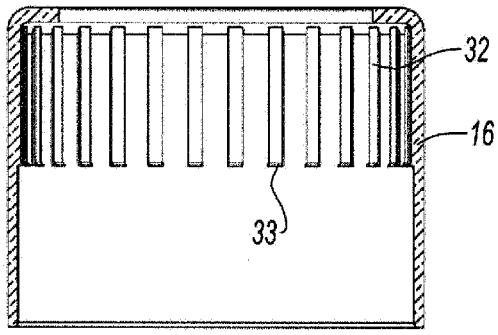
FIG. 4 is a longitudinal section representation of the hoop of the system for fastening according to FIG. 1.

In relation with FIG. 4, the means of fastening include axial streaks 32 which are formed on the interior of the hoop 16, substantially on the upper half of the sliding zone of said hoop. The streaks 32 are arranged in order to be incrusted in the exterior collar 17 during the sliding of the hoop 16 in the bottom position, in such a way as to make the driving in rotation of said exterior collar by said hoop reliable. Alternatively, the cooperation of grooves in ribs can be used.

Moreover, in the bottom position, the lower end of the streaks 32 extends across from the exterior collar 17 in such a way that said streaks are not incrusted in the skirt 12. Furthermore, in the top position, the lower end of the streaks 32 can be incrusted in the exterior collar 17 in order to make the maintaining of the hoop 16 in position reliable during the mounting of the fastening system—pump 3 unit on the neck 2.

Figure 5A:
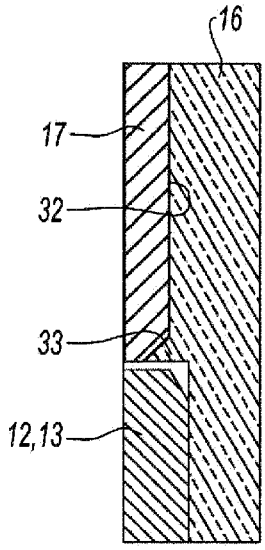
FIG. 5*a* is an enlarged view of the zone A of FIG. 5.

In relation with FIG. 5*a*, the lower end of the streaks 32 have catches 33 which can be obtained via impacting. The catches 33 extend interiorly in order to be engaged under the exterior collar 17 when the hoop 16 is in the bottom position.

As such, the fastening of the exterior collar 17—hoop 16 unit is made reliable in rotation as well as in traction and this, without creating streaks 32 of substantial relief and/or with a cutting-edge profile in the hoop 16, in particular carried out by stamping of a metal material.

What is claimed is:

1. A system for fastening a dispensing pump on a neck of a bottle containing a fluid product, said system comprising a sleeve having an interior collar with a mechanism for fastening of the pump and a lower skirt provided with fasteners for fastening of said sleeve on said bottle, said system further comprising a hoop slidably mounted around the skirt between a top position wherein the fasteners are free in such a way as to allow for positioning of said skirt around the neck and a bottom position wherein the fasteners are constrained by said hoop in order to provide a sealed fastening of the sleeve on said neck, said system further comprising an exterior collar mounted around the interior collar and a device for displacing of said exterior collar between a bottom usage position and a top dismounting position, the hoop in the bottom position being attached to the exterior collar in order to actuate the displacement of said exterior collar towards the top dismounting position by driving said hoop relatively to the skirt on a stroke that is sufficient to release the fasteners, wherein the device for displacing is at least partially actuated by rotation of the hoop, and wherein the hoop is slidably mounted around the exterior collar between the top position and the bottom position.

2. The system for fastening according to claim 1, wherein the device for displacing comprises a lock for locking of the exterior collar at the bottom position, said lock being deactivated by application of a threshold force.

3. The system for fastening according to claim 1, wherein the exterior collar has an interior surface and the interior collar has an exterior surface surrounded by said interior surface, the device for displacing comprising at least one protrusion attached to one of the surfaces, said protrusion being mounted in at least one slideway attached to the other surface, sliding of the protrusion in the slideway inducing the displacement of the exterior collar from the bottom usage position towards the top dismounting position.

4. The system for fastening according to claim 3, wherein the slideway has a housing for retaining of the protrusion, said housing forming a lock for locking of the exterior collar in the bottom position.

5. The system for fastening according to claim 1, wherein an upper edge of the interior collar has a radial core, said core cooperating with a radial core formed in a lower edge of the exterior collar in order to maintain the exterior collar in the top position on the interior collar.

6. The system for fastening according to claim 1, wherein each of the hoop and the exterior collar has, on an interface between the hoop in the bottom position and the exterior collar, corresponding fasteners, said fasteners being interrupted on the interface between the hoop in the bottom position and the skirt.

7. The system for fastening according to claim 6, wherein the fasteners include streaks formed on an inside of the hoop.

8. The system for fastening according to claim 7, wherein a lower end of the streaks has a catch which is engaged under the exterior collar when the hoop is in the bottom position.

9. The system for fastening according to claim 1, wherein the fasteners include claws which are, possibly after pulling back, maintained radially by the hoop in the bottom position in order to provide the sealed fastening of the sleeve on the neck.

10. A bottle for dispensing a fluid product, comprising a body defining a reservoir, a neck surmounting said body by defining an upper opening for said reservoir, and a pump mounted in said upper opening by arranging a tube of said pump inside said reservoir, said bottle further comprising a system of fastening, said system of fastening comprising a sleeve having an interior collar with a mechanism for fastening of the pump and a lower skirt provided with fasteners for fastening of said sleeve on said bottle, said system further comprising a hoop slidably mounted around the skirt between a top position wherein the fasteners are free in such a way as to allow for positioning of said skirt around the neck and a bottom position wherein the fasteners are constrained by said hoop in order to provide the sealed fastening of the sleeve on said neck, said system further comprising an exterior collar mounted around the interior collar and a device for displacing of said exterior collar between a bottom usage position and a top dismounting position, the hoop in the bottom position being attached to the exterior collar in order to actuate the displacement of said exterior collar towards the top dismounting position by driving said hoop relatively to the skirt on a stroke that is sufficient to release the fasteners, wherein the device for displacing is at least partially actuated by rotation of the hoop, wherein the pump is attached to the interior collar and the fasteners of the skirt is constrained by the hoop at the bottom position in order to provide the sealed fastening of the sleeve on the neck, and wherein the hoop is slidably mounted around the exterior collar between the top position and the bottom position.

11. The bottle for dispensing according to claim 10, wherein each of the neck and the sleeve is provided with a corresponding stop for retaining rotation, a retaining force conferred by said stops being greater than a torque required to actuate in rotation the exterior collar from the bottom usage position towards the top dismounting position.

12. The bottle for dispensing according to claim 11, wherein the neck has at least one thrust bearing for stopping in rotation the fasteners.

* * * * *